United States Patent [19]

Anderson

[11] Patent Number: 4,611,648

[45] Date of Patent: Sep. 16, 1986

[54] UNITIZED SECONDARY GLAZING FRAME AND VENETIAN BLIND ASSEMBLY

[75] Inventor: Richard N. Anderson, Owensboro, Ky.

[73] Assignee: Hunter Douglas Inc., Totowa, N.J.

[21] Appl. No.: 681,089

[22] Filed: Dec. 13, 1984

Related U.S. Application Data

[63] Continuation of Ser. No. 455,526, Jan. 4, 1983.

[51] Int. Cl.[4] ..... E06B 3/24

[52] U.S. Cl. ..... 160/107; 49/64

[58] Field of Search ..... 160/107, 178, 90, 91; 49/64, 87, 88

[56] References Cited

U.S. PATENT DOCUMENTS

| | | | |
|---|---|---|---|
| 923,153 | 6/1909 | Dennhardt | 160/102 |
| 2,170,877 | 8/1939 | Simon | 160/107 |
| 2,252,505 | 8/1941 | Harris | 160/95 |
| 2,545,631 | 3/1951 | Ribley | 160/107 |
| 2,565,447 | 8/1951 | Andresen et al. | 49/64 |
| 2,802,243 | 8/1957 | Cialella | 160/107 X |
| 3,129,471 | 4/1964 | Johnson et al. | 49/64 |
| 3,153,819 | 10/1964 | Bond | 160/107 X |
| 3,253,644 | 5/1966 | Gotoh et al. | 160/107 |
| 3,261,393 | 7/1966 | Templeton | 160/237 |
| 3,722,572 | 3/1973 | Hall | 160/107 |
| 4,079,771 | 3/1978 | Theiss | 160/102 |
| 4,369,828 | 1/1983 | Tatro | 160/107 |

FOREIGN PATENT DOCUMENTS

| | | | |
|---|---|---|---|
| 204755 | 5/1966 | Sweden | 160/DIG. 16 |

*Primary Examiner*—Ramon S. Britts
*Assistant Examiner*—Cherney S. Lieberman
*Attorney, Agent, or Firm*—Pennie & Edmonds

[57] ABSTRACT

A unitized secondary glazing frame venetian blind assembly. The secondary frame and blind assembly is adapted to be installed with a prepositioned primary glazing frame such that the blind assembly is positioned between a primary glazing and a secondary glazing. The secondary frame has mounting portions between which the blind assembly is suspended and side extensions overlapping the ends of the slats of the blind assembly.

7 Claims, 14 Drawing Figures

UNITIZED SECONDARY GLAZING FRAME AND VENETIAN BLIND ASSEMBLY

CROSS REFERENCE TO OTHER APPLICATIONS

This is a continuation of application Ser. No. 455,526, filed Jan. 4, 1983.

FIELD OF THE INVENTION

This invention relates generally to venetian blind assemblies used with secondary glazings, for example storm windows. More particularly the invention relates to a unitized secondary glazing frame and venetian blind assembly as well as to structure for tilting the slats in such an assembly.

BACKGROUND OF THE INVENTION

Secondary glazings, for example storm windows, are often installed with prepositioned primary glazings in order to provide improved thermal insulation. In many instances it is desirable to combine the two glazings with a venetian blind assembly. Conventionally this is done by positioning the blind assembly in the interior of a building structure interiorly of the two glazings. The blind assembly in such instances is then subjected to accumulation of dirt and dust existing in the building.

Venetian blind assemblies have been positioned between two glazings where they are sealed from dust and dirt and where special means have been provided to tilt the slats of the blind assembly. Such constructions including two glazings having a venetian blind therebetween are usually factory assembled as a single unit in a single frame with the unit then being installed in a building. While this procedure is practical with buildings under construction, it is impractical in completed buildings having preinstalled primary glazings as the primary glazings must be ripped out in order to allow installation of the double glazing units.

A problem exists in simply positioning a venetian blind assembly next to a primary glazing and then installing a secondary glaZing or storm window next to the blind assembly. In order to provide means to tilt the slat of the blind assembly, the primary glazing or primary frame must be altered such as drilling holes or the like in the frame in order to run a tilting mechanism therethrough so that it can be accessible to an operator. Such alterations add further to the expense of installation.

Further existing prepositioned primary glazings may be preinstalled in an existing building structure in a number of different ways. For example the primary glazing may be included in a casement-type window, may involve a single or double hung sash or may involve thick wall openings such that it would be easier or more practical to install the secondary frame or storm window on the interior side of the building structure rather than, as in the more common practice, on the exterior side of a building structure. Consequently, many different configurations of secondary frames are required in order that secondary glazings may be installed with the various forms of primary glazings as outlined above, and some sort of provision has to be made in each instance to provide a means for tilting the slats of a blind assembly positioned between the two glazings.

It is therefore an object of my invention to provide for a unitized secondary glazing frame and venetian blind assembly which may be installed as a unit with a pre-existing prepositioned primary glazing and which may be installed either on the exterior or interior sides of a building structure.

It is a further object of the invention to provide for a unitized secondary glazing frame and venetian blind assembly which may be readily installed with a vertical or horizontal sliding sash, a fixed sash or a pivoting sash.

It is a further object of the invention to provide for a unitized secondary frame and venetian blind assembly which may be installed in building structures where the spacing between the blind assembly and primary glazing means may differ in several constructions and which can be accommodated by a single common unitized frame and venetian blind assembly.

It is a still further object of the invention to provide for a unitized secondary glazing frame which may be installed with existing prepositioned primary glazings and to provide for a convenient reliable means for tilting the slats of the blind assembly without altering construction of the primary frame and primary glazing.

GENERAL DESCRIPTION OF THE INVENTION

Broadly a unitized secondary glazing frame and venetian blind assembly constructed according to my invention comprises a secondary frame having an upper frame member, a lower frame member and two side frame members enclosing edges of a secondary glazing. Anchor portions project outwardly of the upper and lower frame members in a direction perpendicular to the plane of the secondary glazing and a venetian blind assembly comprising a plurality of slats is suspended between the anchor portions. The frame has oppositely disposed side extensions which project outwardly from the frame to overlap oppositely disposed ends of the slats of the blind and to thus limit movement of the slats in a direction along their longitudinal axes. The unitized secondary glazing frame and attached venetian blind assembly is shipped as a unit to a building site and is installed with a prepositioned primary glazing in a building structure such that the blind assembly is positioned between the prepositioned primary glazing and the secondary glazing.

Preferably the anchor portions comprise extensions of the upper and lower frame members and preferably the side extensions comprise extensions of the two side frame members.

The unitized secondary frame includes mounting means by which the secondary frame may be mounted either on the interior side of a building structure where the secondary glazing faces inwardly of the building or, as is the more usual case, mounted on the exterior of a building structure where the secondary glazing faces exteriorly of the building structure.

The unitized secondary glazing frame may be installed with a prepositioned primary glazing frame enclosing a single primary glazing or with a prepositioned primary glazing frame comprising a fixed primary sash and a slidable primary sash each enclosing a primary glazing. In this latter instance the secondary glazing frame comprises a fixed secondary sash and a slidable secondary sash each enclosing a secondary glazing. The anchor portions projecting outwardly from the frame of the slidable sash are connected to the blind assembly whereby slats of the plurality of slats comprising the blind assembly would be moved upon movement of the slidable sash. In this instance a single blind asssembly would extend over the building opening covered by both the fixed and slidable sashes. The invention also contemplates installations having two slidable sashes in which event anchor portions from which the blind assembly is suspended would be attached to both slidable secondary sashes.

The venetian blind assembly includes a tilting system having as part thereof a linearly movable operating element comprising a first housing having a magnet therein which is movable along a surface of a glazing facing the blind assembly. A linearly movable operable element comprising a second housing having a magnet therein is movable along the surface of the glazing opposite that facing the blind assembly. The magnets of both housings are magnetically coupled so that movement of the operable element will cause the operating element to likewise move and thus tilt the slats of the blind assembly. Thus existing prepositioned primary frames and glazings do not have to be structurally altered to provide a tilt control for blind assemblies combined with later installed secondary frames and glazings.

When the unitized secondary glazing frame and venetian blind assembly is applied to the interior side of the building structure, so as to act as an inside storm window, the operating element is positioned to slide on the surface of the secondary glazing facing the blind assembly while the operable element is positioned to slide on the opposite surface of the secondary glazing facing the interior of the building structure.

Where the unitized secondary glazing frame and venetian blind assembly is applied on the exterior of a building structure to act as an outside storm window, the operating element comprising the first housing is positioned to slide on the surface of the primary glazing facing the blind assembly while the operable element and its housing are positioned to slide upon the opposite surface of the primary glazing facing the interior of the building structure.

It is preferable to include a stroke limiter affixed to the surface of the glazing on which the operating element slides for limiting the stroke or linear movement of the operating element and the stroke limiter preferably includes a retaining means thereon which acts with the operating element to hold it onto the surface of the glazing. The retaining means may comprise a barb on the stroke limiter which extends through a slot contained in the first housing comprising the operating element. In this manner the operating element is prevented from falling from or being jarred loose from the glazing which would require that the unitized secondary glazing frame be removed in order to replace the housing in its proper position on the glazing. A stroke limiter and retaining means may also be included on the opposite surface of the glazing to limit the stroke of and to retain the operable element on the glazing.

The tilting means for the blind mechanism includes a drive cable which may form a separate drive or form a part of the support for the individual slats, as for example part of a tape ladder, and which is connected to the operating element by way of a connecting member. The connecting member is pivotally mounted at one end with respect to the drive cable and at its other end to the operating element so as to pivot in a plane extending perpendicular to the plane of the glazing. In this manner the connecting member may accommodate various spacing between the drive cable and the operating element as may result from different installations with different prepositioned primary glazing frames.

The invention also contemplates a combination of a double glazing construction including two spaced glazings having a venetian blind assembly positioned therebetween with screening and including structure by which an operable element may tilt the slats of the venetian blind assembly. In this instance the screening has a slit therein extending parallel to the direction of linear movement of the operable element and the operable element includes a lever which extends through the slit in the screening so that it may be manually moved from a position on one side of the screen opposite that of the blind assembly. The screening has a screen retainer on one side thereof including a plurality of pegs which extend through interstices in the screening to hold the screening in place in the area of the slit. The retainer has a slot therein which is coextensive with the slit in the screening. The pegs engage a plate positioned on the other side of the screening from the retainer which also has a slot therein coextensive with the slit. The slots in the retainer and plate serve as a guide for the lever connected to the operable element.

A unitized secondary frame enclosing a secondary glazing containing a venetian blind assembly as described above is adaptable for use with the casement-type windows where the window sash is pivotally mounted to be moved to open and closed positions. In this instance the pivotal sash performs the same function as the prepositioned primary sash described earlier and the unitized secondary frame and blind assembly is installed with this sash in the manner as previously described.

DETAILED DESCRIPTION OF THE PREFERRED EMBODIMENTS

Figure 1:
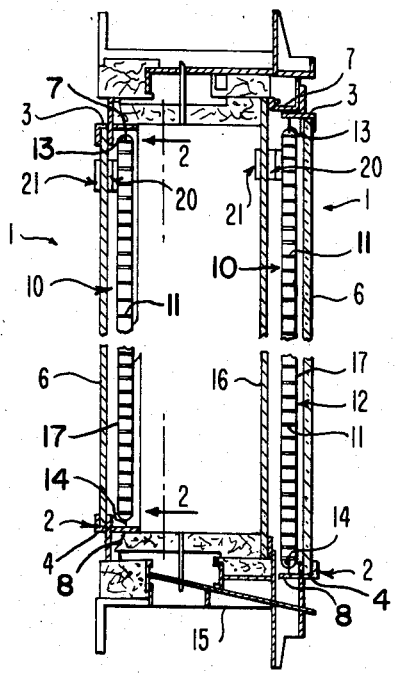
FIG. 1 is a cross-sectional view of a unitized secondary glazing frame and venetian blind assembly constructed according to the invention installed, as shown on the righthand side of the Figure, with a primary glazing frame on the exterior of a building structure, and as shown on the lefthand side of the Figure, installed with a primary glazing frame on the interior of a building structure.
Figure 2:
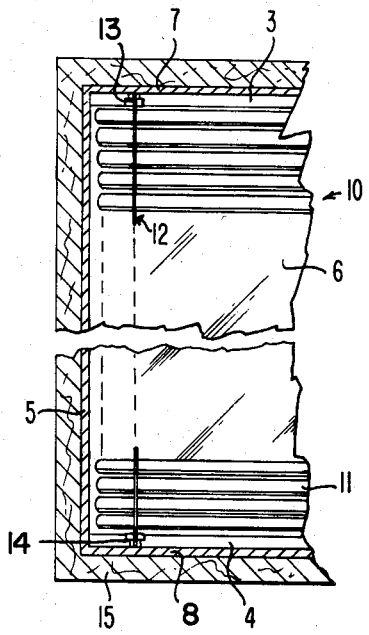
FIG. 2 is a cross-sectional view of FIG. 1 taken along lines 2—2.

Referring to FIGS. 1 and 2 there is illustrated a unitized secondary glazing frame and venetian blind assembly 1 constructed according to the invention where the secondary glazing frame 2 comprises an upper frame member 3, a lower frame member 4 and two side frame members 5, one of which is shown in FIG. 2. The frame members comprising the secondary frame enclose the edges of a secondary glazing 6.

An upper anchor portion 7 and a lower anchor portion 8 both forming a part of the frame 2 extend in a direction perpendicular to the glazing 6 and provide means between which a venetian blind assembly 10 is suspended. The blind assembly 10 in turn comprises a plurality of slats 11 supported by slat support means 12 in the form of tape ladders which extend between the anchor portions and are connected to the upper and lower anchor portions by pivot means 13 and 14. Rotation of the pivot means will in turn cause tilting of the slats.

The unitized secondary glazing frame and venetian blind assembly 1 is adapted to be installed with a prepositioned primary glazing frame 15 enclosing primary glazing 16. As shown on the righthand portion of FIG. 1, the unitized secondary glazing frame and attached venetian blind assembly 1 is installed on the exterior of a building such that the venetian blind assembly is positioned between the secondary glazing 6 and the primary glazing 16.

In some instances depending upon the location of the primary glazing, construction of the primary glazing frame or thickness of the walls of the building structure, it may be desirable to install the secondary glazing frame and venetian blind assembly on the interior of the building structure so that the secondary glazing is interior of the primary glazing as shown on the lefthand portion of FIG. 1. In such event all of the parts of the unitized secondary glazing frame and venetian blind assembly remain the same although their dimensions may be different to accommodate the dimensions of the primary glazing frame.

As shown on the righthand portion of FIG. 1, an operating element 20 is linearly movable in a vertical direction on the surface of the primary glazing 16 and is connected to a drive cable 17 which in the embodiment of the drawings forms part of the slat support means 12 although it could be separate therefrom. An operable element 21 is linearly movable in a vertical direction on the opposite side of the primary glazing from the operating element. The operating element 20 contains a first housing having a magnet therein and the operable element 21 has a second housing having a magnet therein. The magnets in the two elements are magnetically coupled so that linear movement of the operable element 21 will result in linear movement of the operating element 20 and subsequent movement of the drive cable 17 thus tilting the slats of the venetian blind assembly.

When the unitized secondary glazing frame and venetian blind assembly are installed on the interior of the building structure as shown on the lefthand side of FIG. 1, the operating element 20 is positioned to be slidable on the surface of the secondary glazing facing the blind assembly while the operable element is positioned to slide on the opposite surface of the secondary glazing from the blind assembly. Thus, the blind may be tilted by manipulation of the operable element from the interior of the building.

Figure 3:
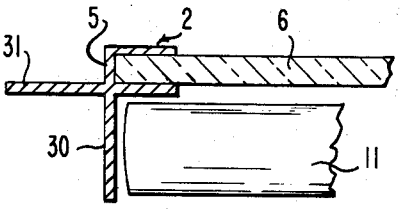
FIG. 3 is an enlarged cross-sectional view of a portion of a unitized secondary frame constructed according to the invention.

An important feature of the unitized secondary glazing frame is to provide side extensions 30 as shown in FIG. 3 which extend beyond the ends of the slats 11 and so serve to limit movement of the slats along their longitudinal axes. As shown in FIG. 3 the side extensions 30 form an extension of the side frame member 5. Also as shown in FIGS. 1 and 2 the upper and lower anchor portions 7 and 8 form extensions of the upper and lower frame members 3 and 4, respectively. Further as shown in FIG. 3 the side extensions 30 and the portion 31 serve as mounting means by which the secondary glazing frame may be installed with a primary glazing frame either on the interior or exterior of a building structure.

Figure 4:
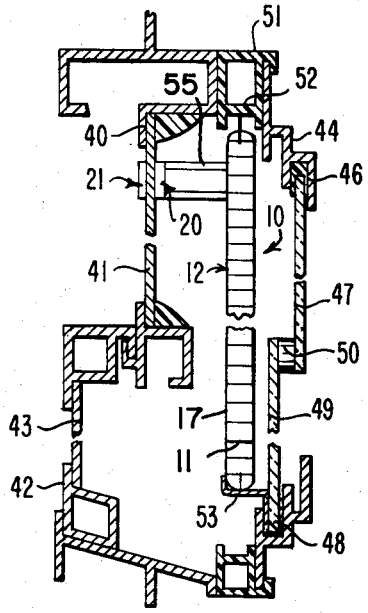
FIG. 4 is a cross-sectional view of a unitized secondary frame and venetian blind assembly constructed according to the invention applied to a primary glazing frame having a double hung upper sash and a lower movable sash.
Figure 1A:
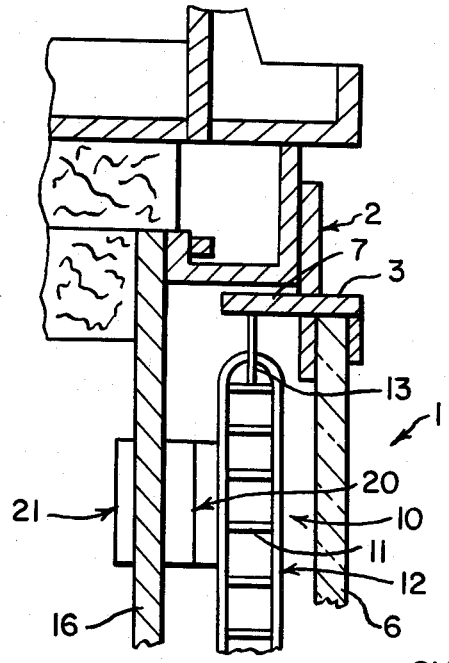
FIG. 1*a* is an enlarged view of the upper right-hand portion of FIG. 1.
Figure 4A:
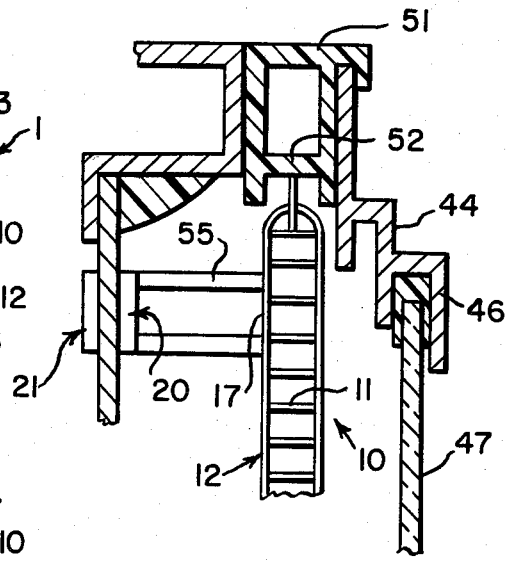
FIG. 4*a* is an enlarged view of the upper right-hand portion of FIG. 4.
Figure 1B:
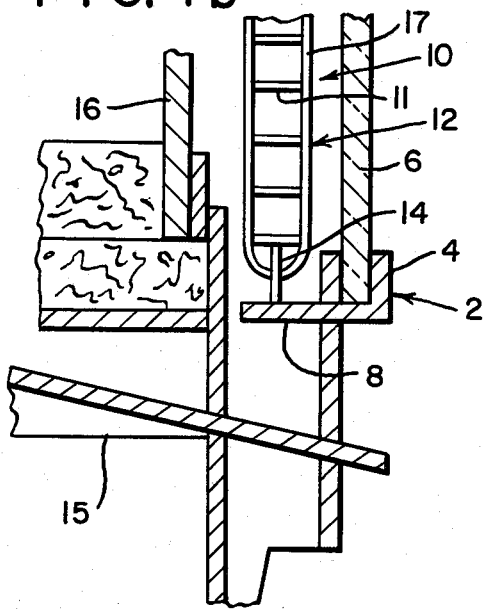
FIG. 1*b* is an enlarged view of the lower right hand portion of FIG. 1.

Referring to FIG. 4 in which like parts have the same identifying numerals as in the preceding drawings, there is illustrated a portion of a building structure having a fixed upper primary sash 40 enclosing an upper primary glazing 41 and a lower primary glazing frame or sash 42 enclosing a lower primary glazing 43. The lower sash 42 is movable vertically with respect to the upper sash 40.

A unitized secondary glazing frame 44 and attached venetian blind assembly 10 is shown installed with the primary sashes 40 and 42 on the exterior of a building structure. The unitized secondary glazing frame comprises an upper sash 46 enclosing an upper fixed secondary glazing 47 and a lower secondary glazing frame or sach 48 enclosing a lower secondary glazing 49 with glazing 49 being separated from glazing 47 by weatherstripping 50. The sash 48 and enclosed glazing 49 is movable vertically with respect to the upper sash 46 and its glazing 47.

A plastic thermal barrier 51 forming part of the secondary glazing frame is positioned against the primary glazing frame and serves to block heat flow from the interior primary glazing frame to the exterior secondary glazing frame. As shown in FIG. 4 the venetian blind assembly 10 is suspended between an anchor portion 52 forming part of the upper frame of the upper sash 46 while a lower portion of the blind is anchored to anchor portion 53 which forms a part of the movable lower secondary sash 48. Thus, movement of the lower sash 48 and its glazing 49 in an upward direction will lift the lower slats of the blind assembly 10. The lower sash 48 is preferably connected by means, not shown, to the same lifting means for the sash 42 so that raising sash 42 would automatically raise sash 48.

In the configuration shown in FIG. 4 the operating element 20 slides along the surface of the upper primary glazing 41 facing the blind assembly 10 while the operable element 21 slides on the opposite surface thereof. In the particular configuration shown the operating element 20 is positioned a considerable distance from the venetian blind assembly 10 requiring a connecting member 55 to connect the operating element with the drive cable means 17. It is important that the operable element 21 connect with the upper portion of the blind assembly in order that the slats may be tilted even when the lower secondary sash 48 is in a raised position.

While the structure of FIG. 4 relates to a construction in which the upper primary and secondary sashes are fixed and the lower primary and secondary sashes are movable vertically, the arrangement could be reversed wherein the lower sashes are fixed and the upper sashes are vertically movable or the arrangement could even include both the upper and lower sashes being vertically movable. The anchor portions between which the blind assembly is suspended would, in the case of the construction having the fixed upper sash and lower movable sash, be connected to the upper part of the movable upper secondary sash and the lower part of the fixed lower secondary sash, and when both sashes are movable, the anchor portions would be connected to the upper part of the upper movable secondary sash and lower part of the lower movable secondary sash. In all cases, the operable element would be connected to the upper portions of the blind assembly to assure tilting when the upper and lower secondary sashes are moved relatively towards one another.

Figure 5:
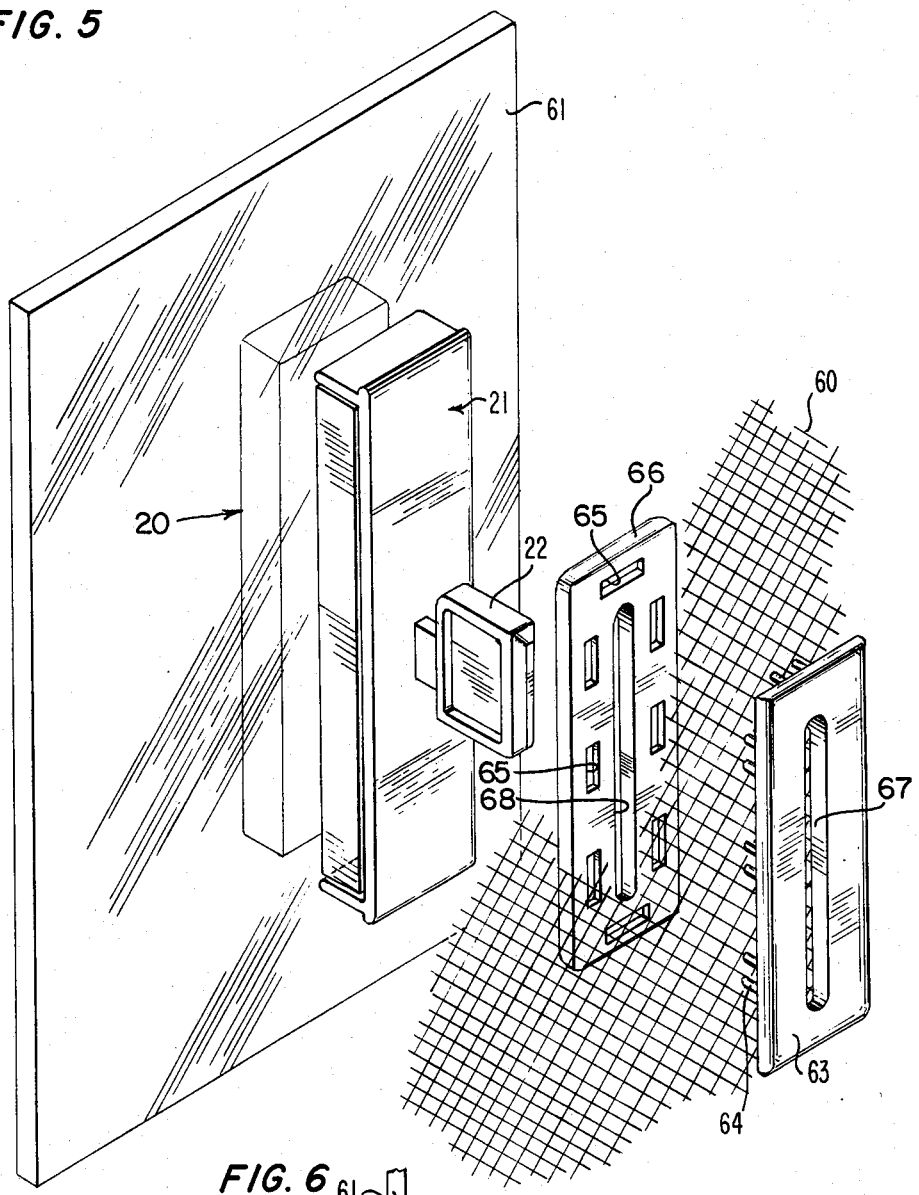
FIG. 5 is an exploded perspective view of a portion of a tilt mechanism constructed according to the invention combined with screening.
Figure 6:
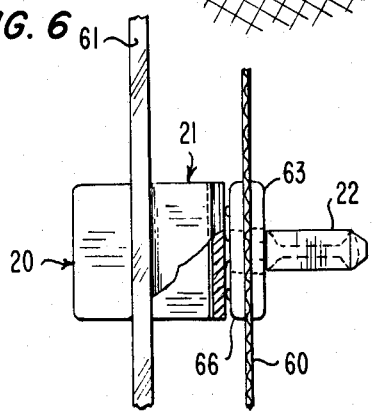
FIG. 6 is a partial cross-sectional view of the parts shown in FIG. 5 in assembled relation.
Figure 7:
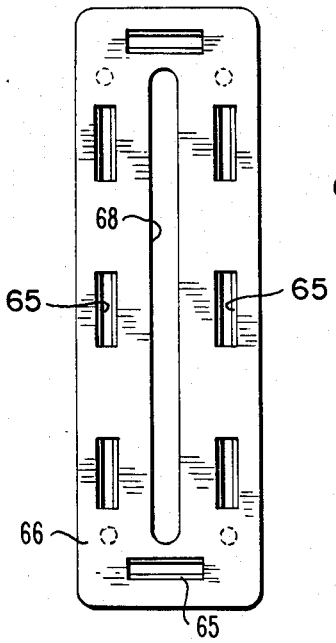
FIG. 7 is a front view of a plate illustrated in FIG. 5.

Referring to FIGS. 5 and 6 there is illustrated an installation of an operable element 21 as used with a tilting mechanism combined with screening 60 which would be prepositioned along the prepositioned primary glazing in a building structure. As shown the operable element 21 is positioned to slide along the surface of a glazing 61 on the opposite side of an operating element 20 which in turn is connected to a venetian blind assembly, not shown. Screening 60 is prepositioned interiorly with respect of a building structure and of the glazing 61. In order that the operable element 21 may be manipulated from the interior of the building structure, the operable element has a lever 22 which extends through a slit contained in the screening.

Figure 9:
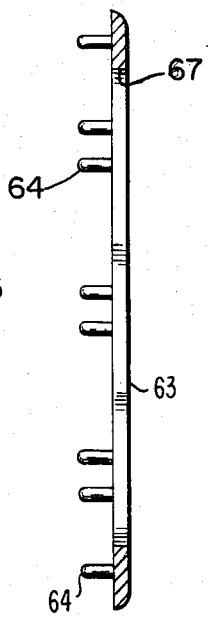
FIG. 9 is a sectional view of FIG. 8 taken along lines 9—9.
Figure 8:
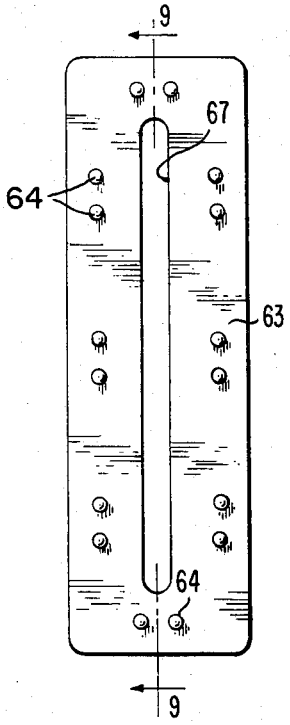
FIG. 8 is a front view of a retainer means illustrated in FIG. 5.

The shape of the screening about the slit is maintained by a retainer means 63 which as shown in FIGS. 8 and 9 has a plurality of pegs 64 which are spaced so as to extend through interstices of the screening. The pegs engage in recesses 65 of a plate 66 on the other side of the screening from the retainer means 63 such that both the retainer means 63 and the plate 66 are held onto the screening. The retainer means has a slot 67 which is coextensive with the slit in the screening while the plate 66 has a slot 68 which is also coextensive with the slit in the screening. The lever 22 attached to the operable element 21 extends through both slots 67 and 68 such that the slots act as a guide for the lever.

In applying the parts to the screening, the retainer means 63 is initially forced onto the screening 60 at the desired position to mate with the lever 22 and so that the pegs 64 protrude through the interstices of the screening. The plate 66 is then applied against the screening on the opposite side thereof from the retainer means and so that the pegs protrude into the recesses 65 to lock the two parts together. A knife is then used to cut a slit in the screening with the pegs maintaining the shape of the screening about the slit.

Figure 10:
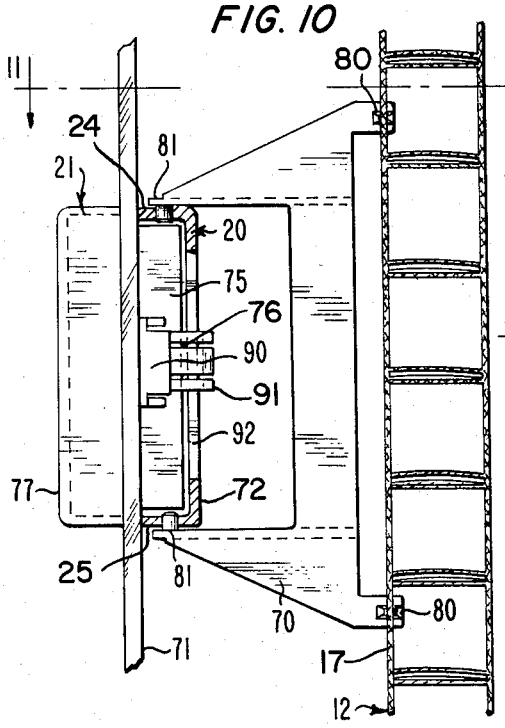
FIG. 10 is an enlarged sectional view illustrating connecting means connecting an operating element constructed according to the invention with a drive cable; and, FIG. 11 is a cross-sectional view of FIG. 10 taken along lines 11—11.
Figure 11:
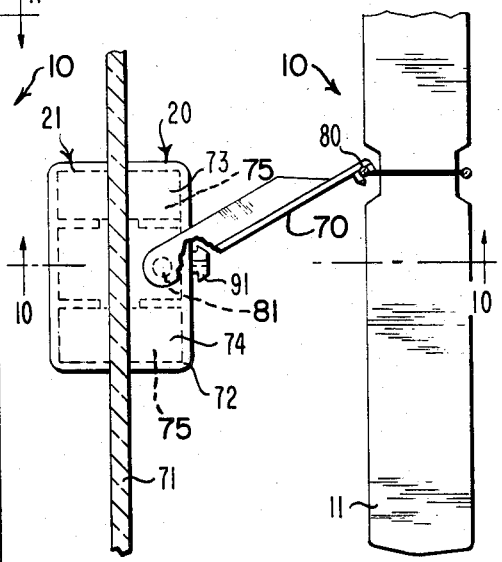

Referring to FIGS. 10 and 11 there is illustrated a venetian blind assembly 10 connected to an operating element 20 by means of a connecting member 70. The operating element 20 which is linearly movable on glazing 71 comprises a first housing 72 divided into two parts 73 and 74 each containing one or more magnets 75 with the parts 73 and 74 being separated by a space 76. The operable element 21 has a second housing 77 linearly movable on glazing 71 and contains magnets, not shown, which are magnetically coupled with magnets 75. Housing 77 may be similar to the first housing 72.

Connecting member 70 is pivotally connected at points 80 to the drive cable 17 and at points 81 to the first housing 72 so as to pivot in a plane perpendicular to the direction of linear movement of the operating element 20. As is apparent from FIG. 11 this construction will allow the connecting member 70 to accommodate various spacing between the blind assembly and the operating element, for example, to accommodate the increased spacing resulting from the installation of the unitized secondary frame and blind assembly in a double hung sash installation as shown in FIG. 4.

The operating element 20 cooperates with a stroke limiter 90 which is affixed to a surface of the glazing 71 and which extends into the space 76 whereby the vertical stroke or extent of linear movement of the operating element is limited by the engagement of the stroke limiter with the inner portions of the top and bottom end walls 24, 25 of the housing.

Preferably the stroke limiter 90 has a retainer means thereon in the form of barbs 91 which extend through a slot 92 in the housing element 72 in order to retain the housing onto the surface of the glazing 71. Thus any possibility of the housing being jarred loose from the glazing and breaking the magnetic couple with the operable element is minimized. This is an important consideration particularly where the operating element is positioned between two glazings because in order to reach and reposition the operating element in the event of its being jarred loose would require disassembly of the double glazed installation.

In some instances, it may be desirable to include a stroke limiter and retainer means with the operable element to assure its being held onto the glazing. This can be accomplished by using a structure similar to limiter 90 and barbs 91 cooperating with a housing element similar to element 72.

While I have disclosed my invention as installed with venetian blind assemblies having horizontally extending slats, the invention would be equally applicable for use with blind assemblies having vertically extending slats. In this event the direction of linear movement of the operating and operable elements on the glazing would be in a horizontal direction rather than a vertical direction as shown in the drawings.

Further the unitized secondary frame and blind assembly constructed according to the invention could be used with sashes that slide in a horizontal direction across a window opening rather than vertically as shown in FIG. 4.

I claim:

1. A double glazing construction including two spaced glazings having a venetian blind assembly positioned therebetween with said blind assembly including a plurality of tiltable slats, a drive cable for tilting said slats, an operating element for moving said drive cable; characterized in that said operating element is linearly movable along a surface of one of said glazings facing said blind assembly and in having a connecting member pivotally mounted at one end to said drive cable and at an opposite end to said operating element to pivot in a plane perpendicular to the direction of linear movement of said operating element whereby the distance between the operating element and the drive cable may be varied.

2. A double glazing construction according to claim 1 wherein said connecting member has a first portion pivotally connected to one end of said operating element and a second portion pivotally connected to an opposite end of said operating element and wherein said connecting member is pivotally connected to said drive cable at two points spaced apart longitudinally of the direction of linear movement.

3. A double glazing construction including two spaced glazings having a venetian blind assembly positioned therebetween with said blind assembly including a plurality of tiltable slats, a tilting means for tilting the slats including a linearly movable operating element comprising a first housing having a magnet therein and movable along a surface of a glazing facing said blind assembly and including a linearly movable operable element comprising a second housing having a magnet therein movable along a surface of the glazing opposite that facing the blind assembly and where the magnets of the first and second housings are magnetically coupled together, stroke limiter means affixed to the surface of said glazing facing the blind assembly for cooperating with said first housing to limit the linear movement thereof, and retaining means on said stroke limiter means for holding said first housing onto the surface of the glazing which comprises a slot in said first housing extending parallel to the direction of linear movement and said retaining means comprises a barb extending through said slot.

4. A unitized glazing frame and venetian blind assembly adapted to be installed with and facing a prepositioned primary glazing frame enclosing a primary glazing, comprising a secondary frame having an upper frame member, a lower frame member and two side frame members enclosing the edges of a secondary glazing, anchor portions projecting outwardly of said upper and lower frame members in a direction perpendicular to the plane of the secondary glazing, a venetian blind assembly comprising a plurality of slats suspended between said anchor portions and adapted to be positioned between the secondary and primary glazings, oppositely disposed side extensions projecting outwardly from said secondary frame to overlap oppositely disposed ends of the slats of the blind assembly to limit movement of the slats in a direction along their longitudinal axes, a tilting means for tilting the slats of said blind assembly including a linearly movable operating element comprising a first housing having a magnet therein and movable along a surface of a glazing facing said blind assembly, a linearly movable operable element comprising a second housing having a magnet therein movable along a surface of the glazing opposite that facing said blind assembly and wherein the magnets of the first and second housings are magnetically coupled together, stroke limiter means affixed to the surface of said glazing facing the blind assembly for cooperating with said first housing to limit the linear movement thereof, and retaining means on said stroke limiter means for holding said first housing onto the surface of the glazing which comprises a slot in said first housing extending parallel to the direction of linear movement and said retaining means comprises a barb extending through said slot.

5. A unitized secondary glazing frame and venetian blind assembly adapted to be installed with and facing a prepositioned primary glazing frame enclosing a primary glazing, comprising a secondary frame having an upper frame member, a lower frame member and two side frame members enclosing the edges of a secondary glazing, anchor portions projecting outwardly of said upper and lower frame members in a direction perpendicular to the plane of the secondary glazing, a venetian blind assembly comprising a plurality of slats suspended between said anchor portions and adapted to be positioned between the secondary and primary glazings, oppositely disposed side extensions projecting outwardly from said secondary frame to overlap oppositely disposed ends of the slats of the blind assembly to limit movement of the slats in a direction along their longitudinal axes, a tilting means for tilting the slats of said blind assembly including a linearly movable operating element comprising a first housing having a magnet therein and movable along a surface of a glazing facing said blind assembly, a linearly movable operable element comprising a second housing having a magnet therein movable along a surface of the glazing opposite that facing said blind assembly and wherein the magnets of the first and second housings are magnetically coupled together, and wherein said blind assembly includes in addition a drive cable forming part of a drive system for tilting said slats, and said tilting means including in addition a connecting member pivotally mounted at one end to said drive cable and at its other end to said first housing to accommodate varying spacing between the drive cable and the first housing.

6. A unitized secondary glazing frame and venetian blind assembly adapted to be installed with and facing a prepositioned primary glazing frame enclosing a primary glazing, comprising a secondary frame having an upper frame member, a lower frame member and two side frame members enclosing the edges of a secondary glazing, a screening extending parallel to said primary glazing on a side opposite thereof from said secondary glazing, anchor portions projecting outwardly of said upper and lower frame members in a direction perpendicular to the plane of the secondary glazing, a venetian blind assembly comprising a plurality of slats suspended between said anchor portions and adapted to be positoned between the secondary and primary glazings, oppositely disposed side extensions projecting outwardly from said secondary frame to overlap oppositely disposed ends of the slats of the blind assembly to limit movement of the slats in a direction along their longitudinal axes, a tilting means for tilting the slats of said blind assembly including a linearly movable operating element comprising a first housing having a magnet therein and movable along a surface of a glazing facing said blind assembly, a linearly movable operable element comprisng a second housing having a magnet therein movable along a surface of the glazing opposite that facing said blind assembly and wherein the magnets of the first and second housing are magnetically coupled together such that linear movement of the second housing will cause said slats to tilt, a lever on said second housing adapted to extend through a slit in said screening whereby said second housing may be moved linearly, a screen retainer on one side of the screening having a slot therein coextensive with said slit and having pegs thereon extending through the interstices of the screening to maintain the screening shape around the slit, and a plate on the opposite side of the screening from said screen retainer means having a slot therein coextensive with said slit and having recesses for receiving said pegs whereby said plate and retainer are held to said screening and wherein the slots in the plate and the retainer serve as a guide for said lever.

7. A combination of a double glazing construction including two spaced glazings having a venetian blind assembly positioned therebetween with said blind assembly including a plurality of tiltable slats and a linearly movable operable element for tilting said slats movable along a surface of one of the glazings opposite that facing the blind assembly, and of screening spaced from said one of the glazings, characterized in that said operable element has a lever extending through a slit in said screening whereby said operable element may be moved linearly to tilt the slats, in having a retainer for maintaining the shape of the screening about the slit, in that said screen retainer is positioned on one side of the screening and has a slot therein coextensive with said slit and has pegs thereon extending through interstices of the screening to maintain the screening shape around the slit, and in having a plate on an opposite side of the screening from said screen retainer having a slot therein coextensive with said slit and having recesses for receiving said pegs whereby said plate and retainer are held to said screening and wherein the slots in the plate and the retainer serve as a guide for said lever.

* * * * *